US009048534B2

(12) United States Patent
Amano et al.

(10) Patent No.: US 9,048,534 B2
(45) Date of Patent: Jun. 2, 2015

(54) WIDE-BAND FEEDER CIRCUIT AND ANTENNA HAVING THE SAME

(75) Inventors: Osamu Amano, Tokyo (JP); Shuichi Koreeda, Tokyo (JP); Yukio Kamata, Tokyo (JP); Makoto Ando, Tokyo (JP)

(73) Assignees: NEC TOSHIBA SPACE SYSTEMS, LTD., Tokyo (JP); JAPAN AEROSPACE EXPLORATION AGENCY, Tokyo (JP)

( * ) Notice: Subject to any disclaimer, the term of this patent is extended or adjusted under 35 U.S.C. 154(b) by 804 days.

(21) Appl. No.: 12/922,743

(22) PCT Filed: Mar. 18, 2009

(86) PCT No.: PCT/JP2009/056027

§ 371 (c)(1), (2), (4) Date: Sep. 15, 2010

(87) PCT Pub. No.: WO2009/116686

PCT Pub. Date: Sep. 24, 2009

(65) Prior Publication Data

US 2011/0006970 A1 Jan. 13, 2011

(30) Foreign Application Priority Data

Mar. 19, 2008 (JP) ..... 2008-071200

(51) Int. Cl.

| | |
|---|---|
| ***H01Q 13/22*** | (2006.01) |
| ***H01Q 1/24*** | (2006.01) |
| ***H01Q 13/18*** | (2006.01) |

(52) U.S. Cl.

CPC ..... *H01Q 1/24* (2013.01); *H01Q 13/18* (2013.01); *H01Q 13/22* (2013.01)

(58) Field of Classification Search

USPC ..... 343/905, 771; 333/239

See application file for complete search history.

(56) References Cited

U.S. PATENT DOCUMENTS

| | | | |
|---|---|---|---|
| 8,138,980 | B2 | 3/2012 | Imano et al. |
| 8,273,605 | B2 | 9/2012 | Tasaki et al. |
| 2006/0163713 | A1 | 7/2006 | Tokunaga |
| 2011/0043416 | A1 | 2/2011 | Imano et al. |
| 2011/0133345 | A1 | 6/2011 | Tasaki et al. |

FOREIGN PATENT DOCUMENTS

| | | |
|---|---|---|
| CN | 1819190 | 8/2006 |
| CN | 1890678 | 1/2007 |

(Continued)

OTHER PUBLICATIONS

International Search Report, PCT/JP2009/056027, Jun. 9, 2009.

(Continued)

*Primary Examiner* — Robert Karacsony

(74) *Attorney, Agent, or Firm* — Young & Thompson

(57) ABSTRACT

It is possible to obtain a wide-band feeder circuit a lower conductive plate provided substantially in parallel to an upper conductive plate, a short-circuit portion provided in a concave manner at a central portion of the lower conductive plate, and a countersunk portion provided in a convex manner at a central portion of a short-circuit plate forming a bottom of the short-circuit portion. It is also possible to obtain an antenna including such a wide-band feeder circuit.

18 Claims, 4 Drawing Sheets

(56) References Cited

FOREIGN PATENT DOCUMENTS

| | | | |
|---|---|---|---|
| CN | 1977419 | | 6/2007 |
| JP | 4-54703 | | 2/1992 |
| JP | 4-085905 | | 7/1992 |
| JP | 5-95224 | | 4/1993 |
| JP | 6-244634 | | 9/1994 |
| JP | 3259098 | B2 * | 2/2002 |
| JP | 2006-074328 | | 3/2006 |

OTHER PUBLICATIONS

Office Action issued Dec. 27, 2012 by the Chinese Patent Office in corresponding Chinese Patent Application No. 200980109793.8 with English translation of relevant part, 7 pages.

Japanese Office Action dated Feb. 27, 2013 in corresponding Japanese Patent Application No. 2008-071200 with English translation of relevant part of Japanese Office Action.

* cited by examiner

WIDE-BAND FEEDER CIRCUIT AND ANTENNA HAVING THE SAME

TECHNICAL FIELD

The present invention relates to an antenna, and more particularly to a wide-band feeder circuit operable in a wide frequency band and an antenna having such a wide-band feeder circuit.

BACKGROUND ART

Various antennas have been used for mobile communication such as satellite communication, a global positioning system (GPS), and cellular phones. Thus, antennas are used for various purposes. Therefore, an increase of the bandwidth is required such that an antenna operates in a wide frequency band. Heretofore, antennas using a device that does not have a very wide band, such as slot antennas, have mainly been used for a parallel-plate transmission mode. However, various applications of a device having a wide band, such as a helical antenna, have been developed recently. Accordingly, a feeder circuit is also required to have a widened band.

There is an antenna developed by the inventors in order to widen the band of an antenna and a feeder circuit. FIG. 1A is a cross-sectional view of an antenna using a feeder circuit for a parallel-plate transmission mode, and FIG. 1B shows return loss characteristics of the antenna. The antenna 1 shown in FIG. 1A has an upper conductive plate 2, a lower conductive plate 3, a coaxial central conductor 4, a guide portion 5, and a short-circuit portion 7. The upper conductive plate 2 and the lower conductive plate 3 are provided substantially in parallel to each other. A central portion of the lower conductive plate 3 is recessed downward so as to form the short-circuit portion 7. A conductor at the bottom of the short-circuit portion 7 forms a short-circuit plate 8. The coaxial central conductor 4 protected by the guide portion 5 is fixed on the short-circuit plate 8 at a central portion of the antenna. In the present invention, the lower conductive plate 3, the coaxial central conductor 4, the guide portion 5, the short-circuit portion 7, and the short-circuit plate 8 of the antenna except the upper conductive plate 2 are collectively referred to as a feeder circuit.

In this antenna, the short-circuit portion 7, which is recessed downward at the central portion of the lower conductive plate 3, serves as an impedance conversion circuit, thereby increasing the bandwidth of frequencies. FIG. 1B shows the frequency dependency of return loss (RL) characteristics of this antenna. The return loss is defined by a ratio of an incident power to an antenna and a reflected power from the antenna. A small value of the return loss means that the antenna matches the frequency. In the present invention, if the return loss is equal to or smaller than −20 dB, i.e., if the loss of power is equal to or less than 1%, then it is determined that an antenna matches the frequency. Therefore, in the case of the antenna shown in FIG. 1, the central frequency is 7.75 GHz, the lower limit frequency is 7.4 GHz, and the upper limit frequency is 7.95 GHz. The bandwidth is 550 MHz, and the fractional bandwidth is 7.1%. The bandwidth of this antenna is wider as compared to conventional antennas and is improved to be 550 MHz. Nevertheless, there is a demand for further increasing the bandwidth of the antenna.

DISCLOSURE OF INVENTION

Problem(s) to be Solved by the Invention

As described above, an increase of the bandwidth of an antenna and a feeder circuit has increasingly been demanded. Thus, there is a problem that a further increase of the bandwidth has been desired.

An object of the present invention is to provide technology for solving the problem that the bandwidth of an antenna and a feeder circuit should be increased and to provide a wide-band feeder circuit operable in a wide frequency band and an antenna having such a wide-band feeder circuit.

Means to Solve the Problem(s)

A wide-band feeder circuit according to the present invention is characterized by comprising a lower conductive plate provided substantially in parallel to an upper conductive plate; a short-circuit portion provided in a concave manner at a central portion of the lower conductive plate; and a countersunk portion provided in a convex manner at a central portion of a short-circuit plate forming a bottom of the short-circuit portion. Furthermore, an antenna according to the present invention is characterized by comprising a wide-band feeder circuit including a lower conductive plate, a short-circuit portion provided in a concave manner at a central portion of the lower conductive plate, and a countersunk portion provided in a convex manner at a central portion of a short-circuit plate forming a bottom of the short-circuit portion; and an upper conductive plate provided substantially in parallel to the lower conductive plate.

EFFECT(S) OF THE INVENTION

According to the present invention, a short-circuit portion is provided in a concave manner on a lower conductive plate. Additionally, a countersunk portion is provided in a convex manner on the short-circuit portion. Thus, the short-circuit portion has a two-stage structure. Therefore, it is possible to increase the bandwidth of an antenna. According to the present invention, it is possible to obtain a wide-band feeder circuit having a wide bandwidth and an antenna for a parallel-plate transmission mode with such a wide-band feeder circuit.

BEST MODE FOR CARRYING OUT THE INVENTION

Embodiments of the present invention will be described in detail with reference to the drawings.

First Embodiment

Figure 1A:
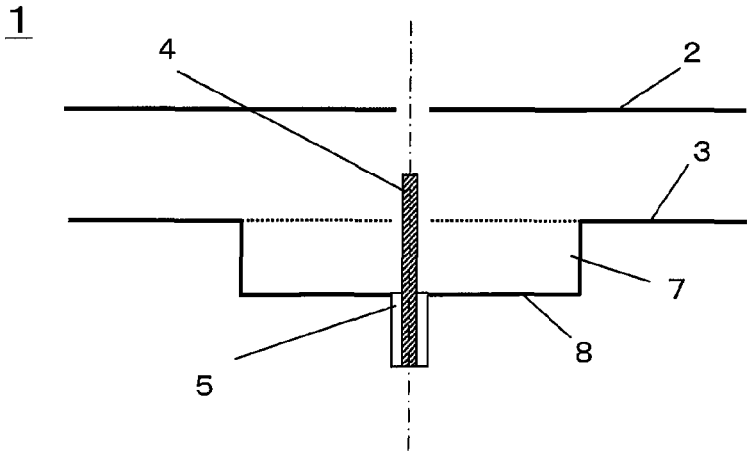
FIG. 1A Related Art
FIG. 1A is a cross-sectional view of a conventional antenna.
Figure 1B:
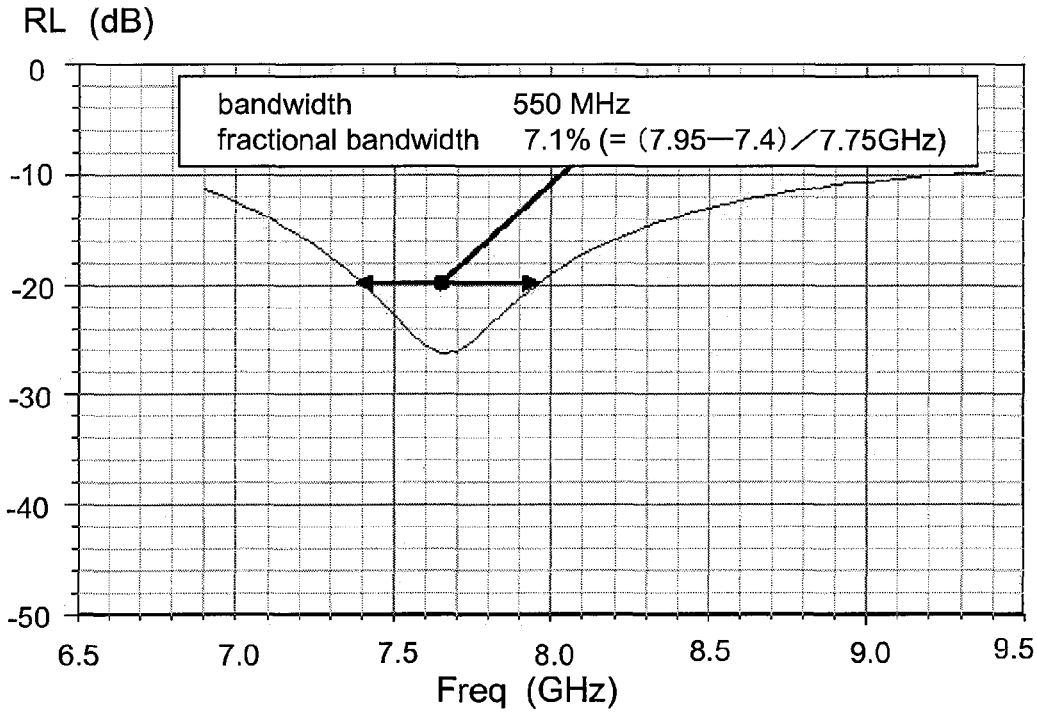
FIG. 1B is a graph showing frequency dependency of return loss characteristics of the antenna shown in FIG. 1A.
Figure 2A:
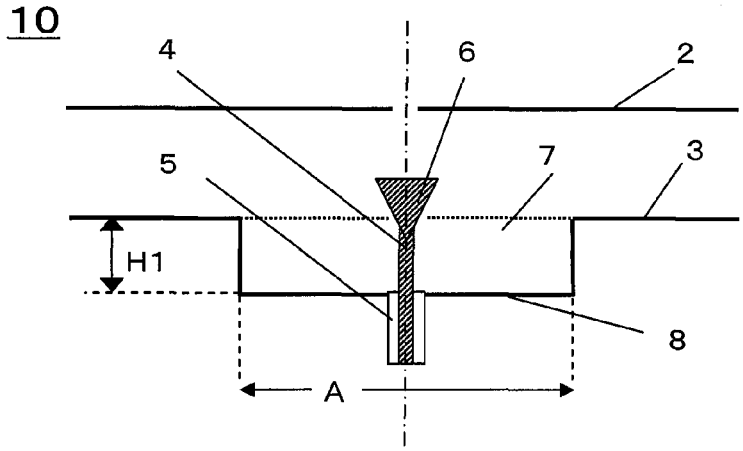
FIG. 2A is a cross-sectional view of an antenna according to a first embodiment of the present invention.
Figure 2B:
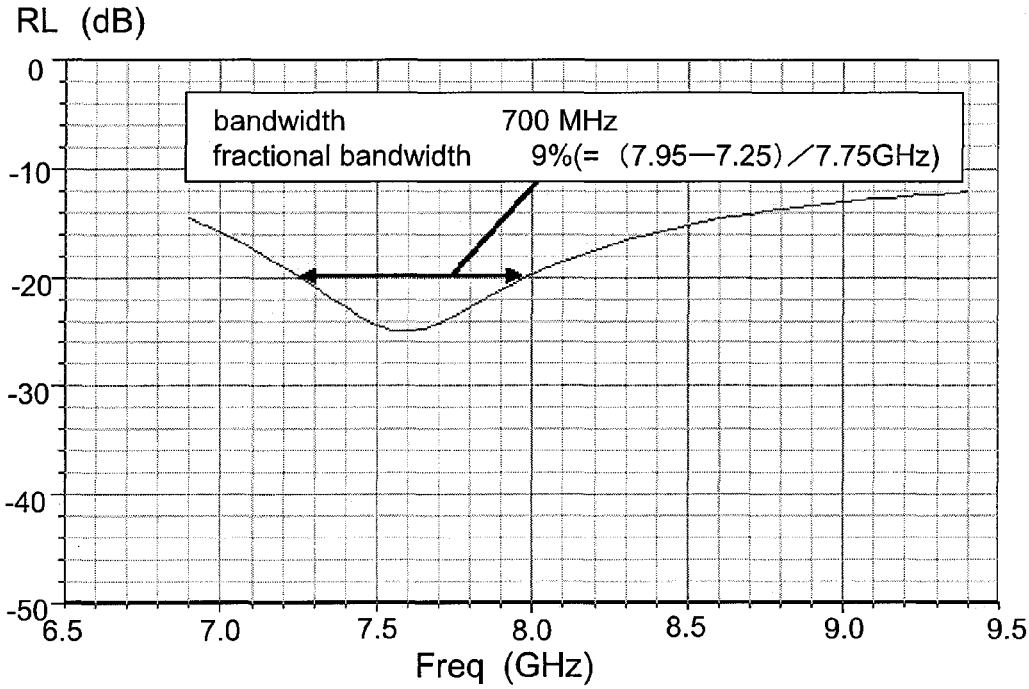
FIG. 2B is a graph showing frequency dependency of return loss characteristics of the antenna shown in FIG. 2A.

A first embodiment of the present invention will be described in detail with reference to FIGS. 2A and 2B. FIG. 2A is a cross-sectional view of an antenna using a feeder circuit for a parallel-plate transmission mode according to the first embodiment of the present invention. FIG. 2B shows the frequency dependency of return loss characteristics of the antenna.

The antenna 10 shown in FIG. 2A has an upper conductive plate 2, a lower conductive plate 3, a coaxial central conductor 4, a guide portion 5, a reverse conical conductor 6, and a short-circuit portion 7. Each of the upper conductive plate 2 and the lower conductive plate 3 is formed of a circular conductor. The upper conductive plate 2 and the lower conductive plate 3 are provided substantially in parallel to each other. Part of a central portion of the lower conductive plate 3 is recessed downward in a circular form so as to form the short-circuit portion 7. The diameter of the short-circuit portion 7 is defined by A, and the depth of the short-circuit portion 7 is defined by H1. A conductive plate at the bottom of the short-circuit portion forms a short-circuit plate 8. The short-circuit plate 8 is substantially in parallel to the upper conductive plate 2 and the lower conductive plate 3. The coaxial central conductor 4 protected by the guide portion 5 is fixed on a central portion of the short-circuit plate 8. Furthermore, the reverse conical conductor 6, which has been thickened in a reverse conical form as shown in FIG. 2A, is provided at a tip of the coaxial central conductor 4. The center of the antenna in a plan view is indicated by a chain line. The centers of the upper conductive plate 2, the lower conductive plate 3, and the short-circuit portion 7 are located on a straight line indicated by the chain line and are thus located substantially at the center of the antenna. Therefore, the coaxial central conductor 4 and the reverse conical conductor 6 are located at the centers of the upper conductive plate 2, the lower conductive plate 3, and the short-circuit portion 7, i.e., at the central portion of the antenna.

The bandwidth can be increased by providing the reverse conical conductor 6 at the tip of the coaxial central conductor 4. The size of the reverse conical conductor 6 can be determined by the frequency to be matched. FIG. 2B shows the frequency dependency of return loss (RL) characteristics of the antenna with the reverse conical conductor 6. Referring to FIG. 2B, the central frequency is 7.75 GHz, the lower limit frequency is 7.25 GHz, and the upper limit frequency is 7.95 GHz. The bandwidth is 700 MHz, and the fractional bandwidth is 9%. Thus, it can be seen that the bandwidth is increased. The antenna exhibits the same central frequency of 7.75 GHz and the same upper limit frequency of 7.95 GHz as the conventional example. However, the lower limit frequency is decreased from 7.4 GHz to 7.25 GHz. As a result, the antenna exhibits an improved bandwidth of 700 MHz and an improved fractional bandwidth of 9%.

According to the present embodiment, a tip of a coaxial central conductor in a feeder circuit is thickened as a reverse conical conductor. Therefore, the lower limit frequency of the antenna is decreased so as to increase the bandwidth and the fractional bandwidth. Thus, a wide-band feeder circuit operable in a wide frequency band and an antenna having such a wide-band feeder circuit can be obtained by thickening a tip of a coaxial central conductor as a reverse conical conductor in a feeder circuit.

Second Embodiment

Figure 3A:
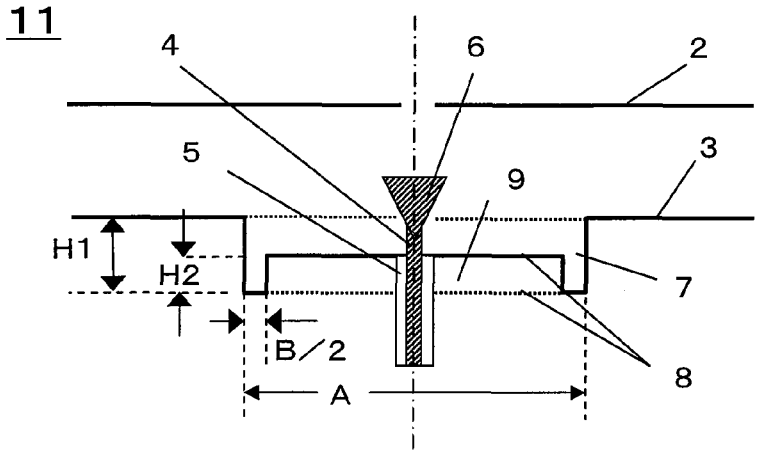
FIG. 3A is a cross-sectional view of an antenna according to a second embodiment of the present invention.
Figure 3B:
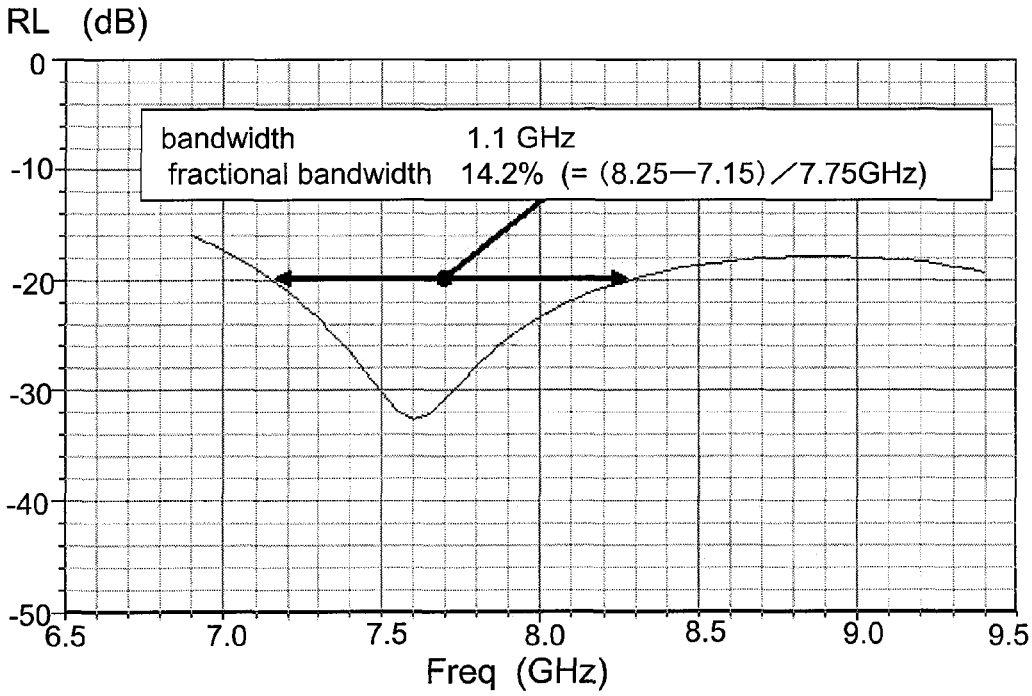
FIG. 3B is a graph showing frequency dependency of return loss characteristics of the antenna shown in FIG. 3A.

A second embodiment of the present invention will be described in detail with reference to FIGS. 3A and 3B. FIG. 3A is a cross-sectional view of an antenna using a feeder circuit for a parallel-plate transmission mode according to the second embodiment of the present invention. FIG. 3B shows the frequency dependency of return loss characteristics of the antenna. In the second embodiment, a countersunk portion is further provided on the short-circuit portion of the first embodiment.

The antenna 11 shown in FIG. 3A has an upper conductive plate 2, a lower conductive plate 3, a coaxial central conductor 4, a guide portion 5, a reverse conical conductor 6, a short-circuit portion 7, a short-circuit plate 8, and a countersunk portion 9. In the configuration of the second embodiment, the countersunk portion 9 is added to the configuration of the first embodiment. The same components as in the configuration of the first embodiment are denoted by the same reference numerals, and the explanation thereof is omitted herein. The countersunk portion 9 is formed in a convex manner projecting toward the short-circuit portion 7 at a central portion of the short-circuit plate 8. The short-circuit portion 7 is formed in a concave manner projecting downward from the lower conductive plate 3. The countersunk portion 9 is formed in a convex manner projecting from the bottom of the short-circuit portion 7 in an upward direction, which is opposite to the direction in which the short-circuit portion 7 projects. The bottom of the countersunk portion 9, which is illustrated on an upper side in FIG. 3A, is substantially in parallel to the upper conductive plate 2 and the lower conductive plate 3.

Each of the countersunk portion 9 and the short-circuit portion 7 has a circular shape. The centers of the countersunk portion 9 and the short-circuit portion 7 are aligned with a straight line indicated by the chain line, which represents the center of the antenna. The diameter of the short-circuit portion 7 is defined by A, and the depth of the short-circuit portion 7 is defined by H1. The countersunk portion 9 is provided inside from an edge of the short-circuit plate by B/2. The diameter of the countersunk portion 9 is defined by (A-B), and the depth of the countersunk portion 9 is defined by H2.

With the countersunk portion 9 provided on the short-circuit portion 7, the short-circuit portion 7 has a two-stage structure. A first stage is formed by a space having a diameter of A, and a second stage is formed by a space in the form of a groove formed below the first stage. The bandwidth of the frequency can further be increased with this two-stage structure. The size of the countersunk portion 9 can be determined by the frequency to be matched. FIG. 3B shows the frequency dependency of return loss (RL) characteristics of the antenna. Referring to FIG. 3B, the central frequency is 7.75 GHz, the lower limit frequency is 7.15 GHz, and the upper limit frequency is 8.25 GHz. Thus, the band is widened. The bandwidth is 1.1 GHz, and the fractional bandwidth is 14.2%. When the present embodiment is compared to the first embodiment, the upper limit frequency is increased from 7.95 GHz to 8.25 GHz, whereas the lower limit frequency is further decreased from 7.25 GHz to 7.15 GHz. As a result, the antenna exhibits an improved bandwidth of 1.1 GHz and an improved fractional bandwidth of 14.2%.

According to the present embodiment, a countersunk portion 9 is provided on a short-circuit portion 7 so that the short-circuit portion has a two-stage structure. Therefore, a difference between the upper limit frequency and the lower limit frequency of the antenna can be enlarged so as to increase the bandwidth and the fractional bandwidth of the antenna. Thus, a wide-band feeder circuit operable in a wide frequency band and an antenna having such a wide-band feeder circuit can be obtained by a short-circuit portion having a two-stage structure.

Third Embodiment

A third embodiment of the present invention will be described in detail with reference to FIGS. 4A and 4B. FIG.

4A is a cross-sectional view of an antenna using a feeder circuit for a parallel-plate transmission mode according to the third embodiment of the present invention. FIG. 4B shows the frequency dependency of return loss characteristics of the antenna. In the third embodiment, sidewalls of the short-circuit portion and the countersunk portion of the second embodiment are tapered.

Figure 4A:
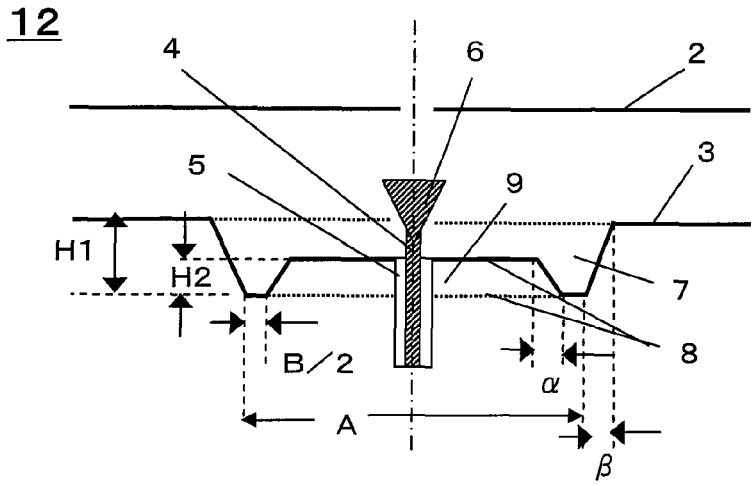
FIG. 4A is a cross-sectional view of an antenna according to a third embodiment of the present invention.
Figure 4B:
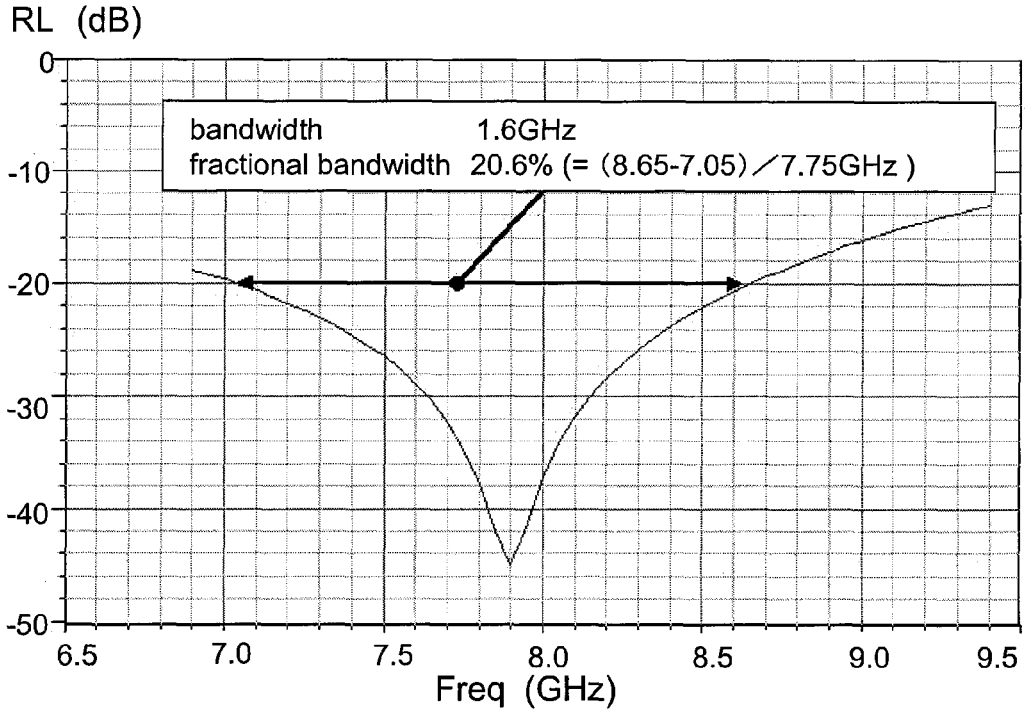
FIG. 4B is a graph showing frequency dependency of return loss characteristics of the antenna shown in FIG. 4A.

The antenna 12 shown in FIG. 4A has an upper conductive plate 2, a lower conductive plate 3, a coaxial central conductor 4, a guide portion 5, a reverse conical conductor 6, a short-circuit portion 7, a short-circuit plate 8, and a countersunk portion 9. The same components as in the configuration of the second embodiment are denoted by the same reference numerals, and the explanation thereof is omitted herein. In the present embodiment, sidewalls of the short-circuit portion 7 and the countersunk portion 9 are tapered and inclined. The sidewall of the short-circuit portion 7 is inclined from the vertical state by a distance of β so as to widen a joint surface of the short-circuit portion 7 with the lower conductive plate 3 by β.

Thus, the sidewall of the short-circuit portion 7 is inclined at β/H1. The sidewall of the countersunk portion 9 is inclined from the vertical state by a distance of a so as to narrow an upper surface of the convex portion by α. Thus, the sidewall of the countersunk portion 9 is inclined at α/H2. In this manner, the sidewalls of the short-circuit portion 7 and the countersunk portion 9 are tapered and inclined. The inclinations of β/H1 and α/H2 can be determined by the frequency to be matched.

When the sidewalls of the short-circuit portion 7 and the countersunk portion 9 are tapered and inclined, the bandwidth of the frequency can further be increased. With the inclined sidewalls, the short-circuit locations and the short-circuit radius are made ambiguous, so that the bandwidth is further increased. FIG. 4B shows the frequency dependency of return loss (RL) characteristics of the antenna. Referring to FIG. 4B, the central frequency is 7.75 GHz, the lower limit frequency is 7.05 GHz, and the upper limit frequency is 8.65 GHz. The bandwidth is 1.6 GHz, and the fractional bandwidth is 20.6%. Thus, it can be seen that the bandwidth is further increased. When the present embodiment is compared to the second embodiment, the upper limit frequency is increased from 8.25 GHz to 8.65 GHz, whereas the lower limit frequency is decreased from 7.15 GHz to 7.05 GHz. As a result, the antenna exhibits an improved bandwidth of 1.6 GHz and an improved fractional bandwidth of 20.6%.

According to the present embodiment, a countersunk portion 9 is provided on a short-circuit portion 7, and sidewalls of the short-circuit portion 7 and the countersunk portion 9 are inclined. Therefore, a difference between the upper limit frequency and the lower limit frequency of the antenna can be enlarged so as to further increase the bandwidth and the fractional bandwidth of the antenna. Thus, a wide-band feeder circuit operable in a wide frequency band and an antenna having such a wide-band feeder circuit can be obtained by inclining sidewalls of a short-circuit portion and a countersunk portion.

The present invention has been described with some embodiments. A wide-band feeder circuit according to the present invention is characterized by having a lower conductive plate provided substantially in parallel to an upper conductive plate; a short-circuit portion provided in a concave manner at a central portion of the lower conductive plate; and a countersunk portion provided in a convex manner at a central portion of a short-circuit plate forming a bottom of the short-circuit portion.

Furthermore, a sidewall of the short-circuit portion of the wide-band feeder circuit may be inclined. Moreover, a sidewall of the countersunk portion may also be inclined. Each of the short-circuit portion and the countersunk portion may have a circular shape. The centers of the short-circuit portion and the countersunk portion may be aligned with the same straight line. Furthermore, the wide-band feeder circuit may have a coaxial central conductor protected at the center of the countersunk portion by a guide portion, and a reverse conical conductor may be formed at a tip of the coaxial central conductor.

Moreover, according to the present invention, it is possible to obtain an antenna including the aforementioned wide-band feeder circuit. This antenna can be used for a parallel-plate transmission mode.

While the present invention has been described with reference to the embodiments, the present invention is not limited to the aforementioned embodiments. It would be apparent to those skilled in the art that various changes may be made in configuration and details of the present invention without departing from the scope of the present invention.

This application claims the benefit of priority from Japanese patent application No. 2008-071200, filed on Mar. 19, 2008, the disclosure of which is incorporated herein in its entirety by reference.

The invention claimed is:

1. A wide-band feeder circuit comprising:

a lower conductive plate provided substantially in parallel to an upper conductive plate;

a coaxial central conductor; and a guide portion, wherein the lower conductive plate provides a short-circuit portion in a concave manner at a central portion thereof and a countersunk portion in a convex manner at a central portion of the short-circuit portion, and the coaxial central conductor is protected at a center of the countersunk portion by the guide portion.

2. The wide-band feeder circuit as recited in claim 1, wherein a sidewall of the short-circuit portion is inclined.

3. The wide-band feeder circuit as recited in claim 2, wherein a sidewall of the countersunk portion is inclined.

4. The wide-band feeder circuit as recited in claim 3, wherein each of the short-circuit portion and the countersunk portion has a circular shape, and centers of the short-circuit portion and the countersunk portion are aligned with the same straight line.

5. The wide-band feeder circuit as recited in claim 1, wherein a reverse conical conductor is formed at a tip of the coaxial central conductor.

6. The wide-band feeder circuit as recited in claim 1, wherein the wide-band feeder circuit comprises an antenna with a central frequency of 7.75 GHz, a lower limit frequency of 7.25 GHz, and an upper limit frequency of 7.95 GHz.

7. The wide-band feeder circuit as recited in claim 6, wherein a bandwidth is 700 MHz and a fractional bandwidth is 9%.

8. The wide-band feeder circuit as recited in claim 1, wherein the wide-band feeder circuit comprises an antenna with a central frequency of 7.75 GHz, a lower limit frequency of 7.15 GHz, and an upper limit frequency of 8.25 GHz.

9. The wide-band feeder circuit as recited in claim 6, wherein a bandwidth is 1.1 GHz and a fractional bandwidth is 14.2%.

10. An antenna comprising:

an upper conductive plate; and a wide-band feeder circuit including a lower conductive plate provided substantially in parallel to the upper conductive plate, a coaxial central conductor and a guide portion, wherein the lower conductive plate provides a short-circuit portion in a concave manner at a central portion thereof, and a countersunk portion in a convex manner at a central portion of the short-circuit portion, and the coaxial central conductor is protected at a center of the countersunk portion by the guide portion.

11. The antenna as recited in claim 10, wherein a sidewall of the short-circuit portion is inclined.

12. The antenna as recited in claim 11, wherein a sidewall of the countersunk portion is inclined.

13. The antenna as recited in claim 12, wherein each of the short-circuit portion and the countersunk portion has a circular shape, and centers of the short-circuit portion and the countersunk portion are aligned with the same straight line.

14. The antenna as recited in claim 10, wherein a reverse conical conductor is formed at a tip of the coaxial central conductor.

15. The antenna as recited in claim 10, wherein the antenna with a central frequency of 7.75 GHz, a lower limit frequency of 7.25 GHz, and an upper limit frequency of 7.95 GHz.

16. The antenna as recited in claim 15, wherein a bandwidth is 700 MHz and a fractional bandwidth is 9%.

17. The antenna as recited in claim 10, wherein the wide-band feeder circuit comprises an antenna with a central frequency of 7.75 GHz, a lower limit frequency of 7.15GHz, and an upper limit frequency of 8.25 GHz.

18. The antenna as recited in claim 15, wherein a bandwidth is 1.1 GHz and a fractional bandwidth is 14.2%.

* * * * *